US010907377B2

(12) United States Patent
Shah et al.

(10) Patent No.: US 10,907,377 B2
(45) Date of Patent: Feb. 2, 2021

(54) QUIET PANIC DEVICE HAVING SOUND DAMPENING MATERIALS

(71) Applicant: ARCHITECTURAL BUILDERS HARDWARE MFG., INC., Itasca, IL (US)

(72) Inventors: Ankit Kirti Shah, Chicago, IL (US); George Vavrek, Berwyn, IL (US)

(73) Assignee: ARCHITECTURAL BUILDERS HARDWARE MFG., INC., Itasca, IL (US)

( * ) Notice: Subject to any disclaimer, the term of this patent is extended or adjusted under 35 U.S.C. 154(b) by 1049 days.

(21) Appl. No.: 15/345,081

(22) Filed: Nov. 7, 2016

(65) Prior Publication Data

US 2018/0128015 A1 May 10, 2018

(51) Int. Cl.

| | |
|---|---|
| ***E05B 15/16*** | (2006.01) |
| ***E05B 17/00*** | (2006.01) |
| ***E05B 65/10*** | (2006.01) |

(52) U.S. Cl.

CPC ..... *E05B 17/0045* (2013.01); *E05B 15/16* (2013.01); *E05B 65/1053* (2013.01)

(58) Field of Classification Search

CPC ... E05B 17/0045; E05B 15/16; E05B 65/1053
See application file for complete search history.

(56) References Cited

U.S. PATENT DOCUMENTS

| | | | |
|---|---|---|---|
| 1,194,636 | A | 8/1916 | Joy |
| 1,620,414 | A | 3/1927 | Vanderlip |
| 2,029,711 | A | 2/1936 | Frantz |
| 2,073,149 | A | 3/1937 | Geyer |
| 2,125,655 | A | 8/1938 | Schlage |
| 2,159,315 | A | 5/1939 | Blue |
| 2,194,801 | A | 3/1940 | Lindstrom |
| 2,823,941 | A | 2/1958 | Ellis |
| 3,089,720 | A | 5/1963 | Schlage |
| 3,153,552 | A | 10/1964 | Sandor |
| 3,637,246 | A | 1/1972 | Leiter |
| 4,007,954 | A | 2/1977 | Erickson |
| 4,358,141 | A | 11/1982 | Hamada |
| 4,482,179 | A | 11/1984 | Johnson |
| 4,896,908 | A | 1/1990 | Kleefeldt |
| 4,986,583 | A | 1/1991 | Campbell et al. |
| 5,690,371 | A | 11/1997 | Turnbull |
| 5,730,478 | A | 3/1998 | D'Hooge |
| 5,862,570 | A | 1/1999 | Lezuch et al. |
| 6,196,599 | B1 | 3/2001 | D'Hooge |
| 6,293,598 | B1 | 9/2001 | Rusiana |
| 6,570,757 | B2 | 5/2003 | DiFonzo et al. |

(Continued)

*Primary Examiner* — Kristina R Fulton
*Assistant Examiner* — Thomas L Neubauer
(74) *Attorney, Agent, or Firm* — Greer, Burns & Crain, Ltd

(57) ABSTRACT

A panic device for rapidly unlocking an entryway includes a touch bar handle configured for activating the panic device; and a push arm assembly mechanically connected to the touch bar handle, and configured for operating a latch mechanism connected to the push arm assembly via a plurality of linkages. Activation of the panic device, including depressing the touch bar handle, activating the push arm assembly, and the operation of the latch mechanism generates a noise reduction in the range of approximately 20-99 percent and at least 30 decibels during operation of the latch mechanism.

20 Claims, 11 Drawing Sheets

(56) References Cited

U.S. PATENT DOCUMENTS

| | | | | |
|---|---|---|---|---|
| 6,733,049 | B2 * | 5/2004 | Piorkowski | B64C 1/1469 292/139 |
| 6,769,723 | B2 * | 8/2004 | Cohrs, Jr. | E05B 65/1053 292/92 |
| 7,182,373 | B2 * | 2/2007 | Yamada | E05B 83/30 292/141 |
| 7,258,374 | B2 | 8/2007 | Rusiana | |
| 7,481,607 | B2 | 1/2009 | Rusiana et al. | |
| 7,677,614 | B2 | 3/2010 | Monig | |
| 7,841,632 | B2 | 11/2010 | Tracy et al. | |
| 7,866,714 | B2 | 1/2011 | Monig et al. | |
| 7,905,525 | B2 | 3/2011 | Badia | |
| 8,403,374 | B2 | 3/2013 | Shimizu et al. | |
| 8,491,020 | B2 | 7/2013 | Lopes | |
| 8,807,607 | B2 | 8/2014 | Glickman | |
| 2009/0315342 | A1 | 12/2009 | Dalton, Jr. et al. | |
| 2010/0253101 | A1 | 10/2010 | Seto et al. | |
| 2012/0272697 | A1 | 11/2012 | Motherwell | |
| 2013/0076046 | A1 | 3/2013 | Shah et al. | |
| 2015/0021933 | A1 | 1/2015 | Shin et al. | |

* cited by examiner

QUIET PANIC DEVICE HAVING SOUND DAMPENING MATERIALS

BACKGROUND

The present disclosure generally relates to exit devices mounted on a door in an entryway, and more particularly relates to a panic device for rapidly unlocking the entryway.

Conventional panic devices commonly incorporate a push bar or plate spanning a width of the entryway, which is pushed to unlatch and swing the door open for access. In use, the panic devices translate inward and outward movement of the push bar into operation of a latch mechanism connected to the push bar. For example, such panic devices are typically mounted on exit doors, such as emergency escape doors. A dependable and quick operation of such panic devices is important and desired.

However, conventional panic devices often include complicated mechanisms for providing orthogonal or rectilinear movement of the push bar to operate the latch mechanism. For facilitating the locking and unlocking movement of the latch mechanism, the conventional panic devices typically generate significant impact or operating noise caused by the operation of the push bar. This noise can cause undesirable effects for certain users in a specific environment. For example, in a hospital, the impact or operating noise from the panic devices can cause patients to lose sleep, instigate a higher blood pressure or heart rate, and be more psychologically agitated as a whole. Consequently, not only are the patients experiencing negative physical symptoms, but medical staff members can also become more stressed and exhausted in such a noisy environment. Ambient noise in typical hospital work environments is about 40-42 decibels (dB). A conventional door latch and door handle assembly may generate over 30 additional decibels of noise when a door is opened.

Therefore, there is a need for improving panic devices to suppress the impact or operating noise of the panic device during use.

SUMMARY

Included in the present panic device are a touch bar handle configured for activating the panic device, and a push arm assembly mechanically connected to the touch bar handle. The locking and unlocking operation of the present panic device is achieved by a latch mechanism connected to the push arm assembly via a plurality of linkages between the touch bar and push arm assemblies. It is advantageous that the present panic device is constructed and arranged to generate between 0.01 and 15 decibels over ambient noise.

An important aspect of the present panic device is that activation of the panic device, including depressing the touch bar handle, activating the push arm assembly, and the operation of the latch mechanism generates a noise reduction in the range of approximately 20-99% and at least 30 decibels during operation of the latch mechanism. More specifically, at least one and preferably most if not all of the mechanical touch points between the touch bar handle and the push arm assembly has a sound dampening material selectively disposed between contacting metal surfaces of the present panic device for reducing or suppressing the impact or operating noise of the panic device during use.

In one embodiment, a panic device for rapidly unlocking an entryway includes a touch bar handle configured for activating the panic device. A push arm assembly is mechanically connected to the touch bar handle, and is configured for operating a latch mechanism connected to the push arm assembly via a plurality of linkages. Activation of the panic device, including depressing the touch bar handle, activating the push arm assembly, and the operation of the latch mechanism generates a noise reduction in the range of approximately 20-99% compared to conventional panic devices, and in the range of approximately 20-50 decibels during operation of the latch mechanism.

In another embodiment, a panic device for rapidly unlocking an entryway includes a touch bar handle configured for activating the panic device. A push arm assembly is mechanically connected to the touch bar handle, and is configured for operating a latch mechanism connected to the push arm assembly via a plurality of linkages. A plurality of mechanical touch points is disposed between the touch bar handle and the push arm assembly, and at least one sound dampening material is disposed between opposing metal surfaces of at least one of the plurality of mechanical touch points.

The foregoing and other aspects and features of the disclosure will become apparent to those of reasonable skill in the art from the following detailed description, as considered in conjunction with the accompanying drawings.

DETAILED DESCRIPTION

Figure 1:
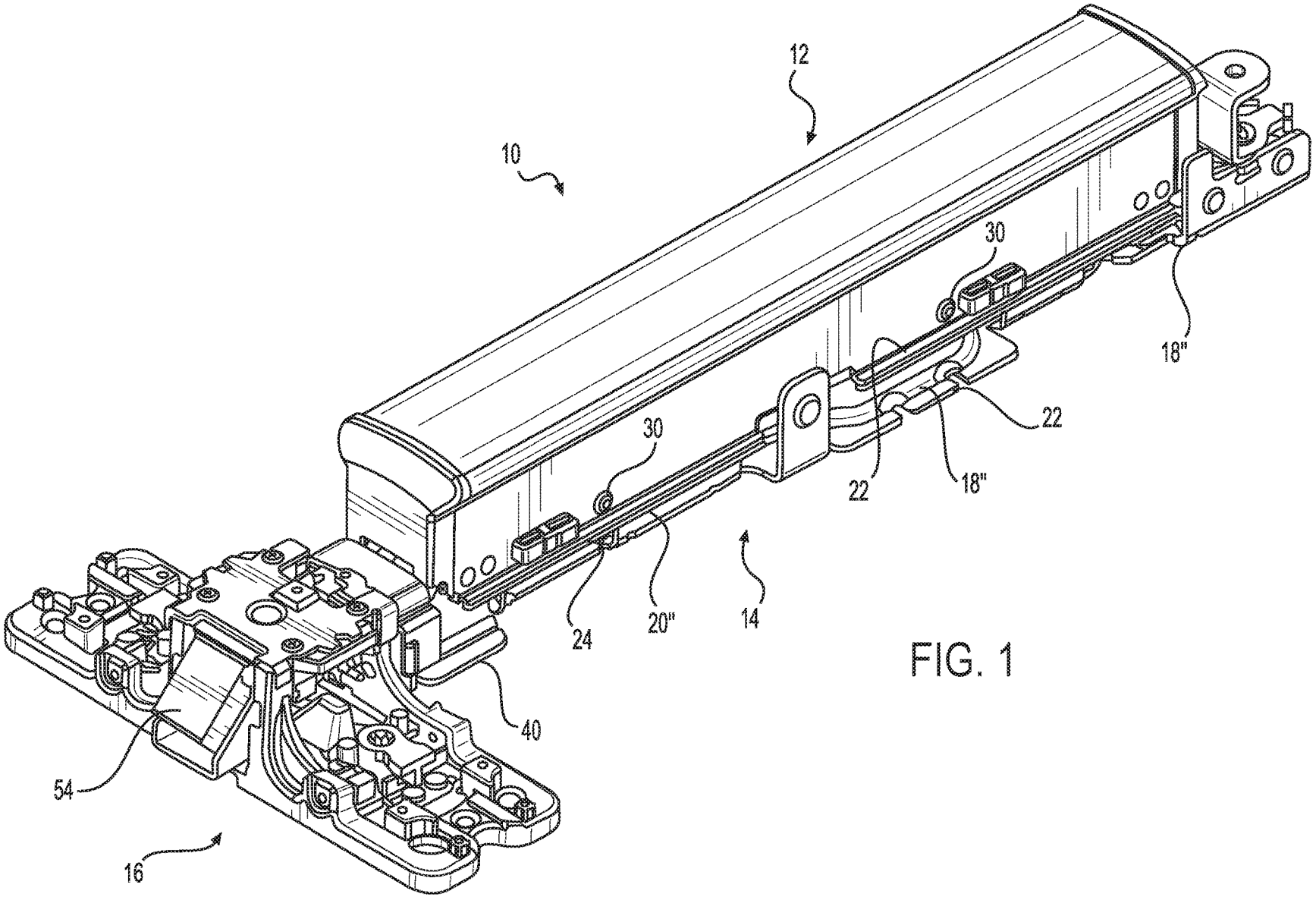
FIG. 1 is a top perspective view of the present panic device, featuring a touch bar handle and a push arm assembly, in accordance with an embodiment of the present disclosure.
Figure 2:
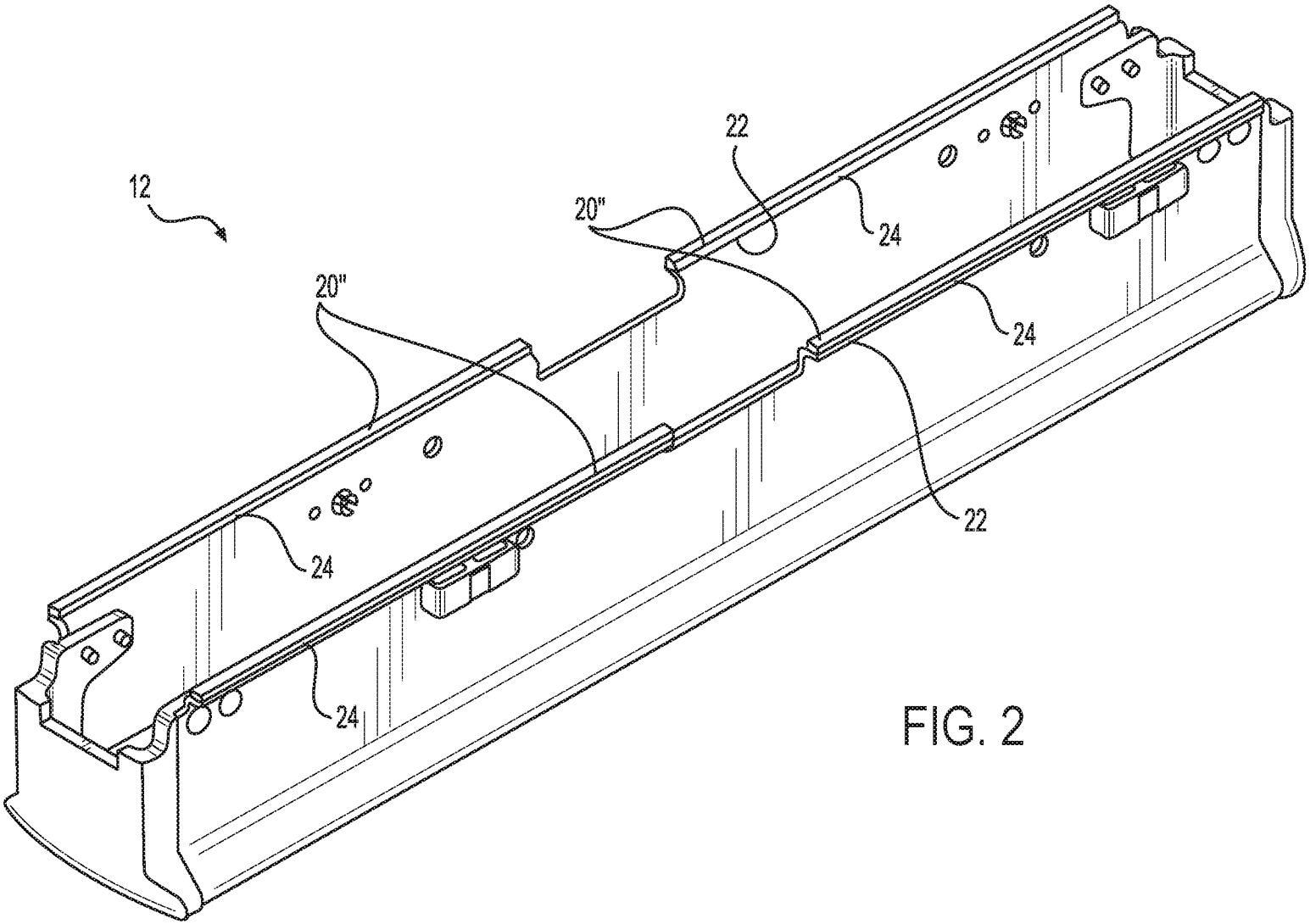
FIG. 2 is a bottom perspective view of the touch bar handle of FIG. 1 with the touch bar handle removed.

Referring now to FIGS. 1 and 2, the present panic device is generally designated 10 and is designed for rapidly unlocking an entryway, such as a door (not shown). Included in the present panic device 10 is a touch bar handle, generally designated 12, and is configured for activating the panic device. A push arm assembly, generally designated 14, is mechanically connected to the touch bar handle 12, and is configured for operating a latch mechanism, generally designated 16. Attachment of the latch mechanism 16 to the push arm assembly 14 is achieved by a plurality of linkages disposed in the present panic device 10. Detailed descriptions of the plurality of linkages are provided below in paragraphs relating to FIGS. 6A-9B.

An important aspect of the present panic device 10 is that activation, including depressing the touch bar handle 12, activating the push arm assembly 14, and the operation of the latch mechanism 16 generates a noise reduction in the range of approximately 20-99% and in the range of approximately 20-50 decibels during operation. In a preferred embodiment, the present panic device 10 has a plurality of mechanical touch points (or sound generating areas) 18', 18", 18'" (FIG. 4; collectively designated 18) between the touch bar handle 12 and the push arm assembly 14, and at least one of the mechanical touch points has a sound dampening material 20', 20", 20'" (FIG. 4; collectively designated 20) disposed between contacting metal surfaces 22 of the present panic device. It is contemplated that the sound dampening material 20 includes at least one of: at least partially, a non-metallic washer, a sound absorbing pad, and a grommet, and other suitable materials, as known in the art.

In one embodiment, the touch bar handle 12 includes at least one sound dampening material 20 between the touch bar handle and the push arm assembly 14. For example, the noise reduction is achieved by the sound dampening material 20 disposed on an outer edge 24 of the touch bar handle 12, such that when the touch bar handle is depressed to activate or unlatch the latch mechanism 16, the sound dampening material is sandwiched between the edge 24 of the touch bar handle 12 and the push arm assembly 14 at at least one of the mechanical touch points 18. As described in greater detail below, it is contemplated that similar configurations are employed throughout the present panic device 10 for suppressing the impact or operating noise.

As a result, the sound dampening material 20 of the present panic device 10, individually or in combination, dampen sound generated by the panic device such that an increase in sound over ambient noise (which can range from 40 to 42 decibels) is substantially reduced compared to conventional panic devices, which add up to 30 decibels over ambient noise in a hospital room. It is contemplated that the present panic device 10 is constructed and arranged to generate between approximately 0.01 and 15 decibels over ambient noise, and an increase in sound over ambient noise is less than 5 decibels.

Referring now to FIGS. 1 and 3-5, it is preferred that the present panic device 10 is configured to generate a transmission force between the touch bar handle 12 and the push arm assembly 14, such that the latch mechanism 16 is operated by the transmission force along a force path created by the plurality of linkages. Included in the linkages is a mounting bracket 26 connected to the touch bar handle 12, and at least one sound dampening material 20 is disposed between the mounting bracket and the push arm assembly 14.

More specifically, it is preferred that the mounting bracket 26 is pivotally connected to the push arm assembly 14 using a pin 28 via a push arm 29, and is removably attached to the touch bar handle 12 using at least one fastener 30 (FIG. 1) for engaging a corresponding number of mounting holes 31 in the bracket. When the touch bar handle 12 is depressed, the push arm 29 pivots downwardly and laterally retracts an action rod 32 along a longitudinal axis of the push arm assembly 14 as is known in the art. A force path created by the touch bar handle 12, the mounting bracket 26, and the push arm 29 actuates the action rod 32 connected to the push arm to move against the force of a biasing device 34, such as a spring. During operation, at least one mechanical touch point 18 (FIG. 3) is associated with the pin 28, the action rod 32, and the push arm assembly 14. As a result of the action of the force path, the latch mechanism 16 is unlatched. Detailed descriptions of the latch mechanism 16 are provided below in paragraphs relating to FIGS. 6A-6D.

Figure 4:
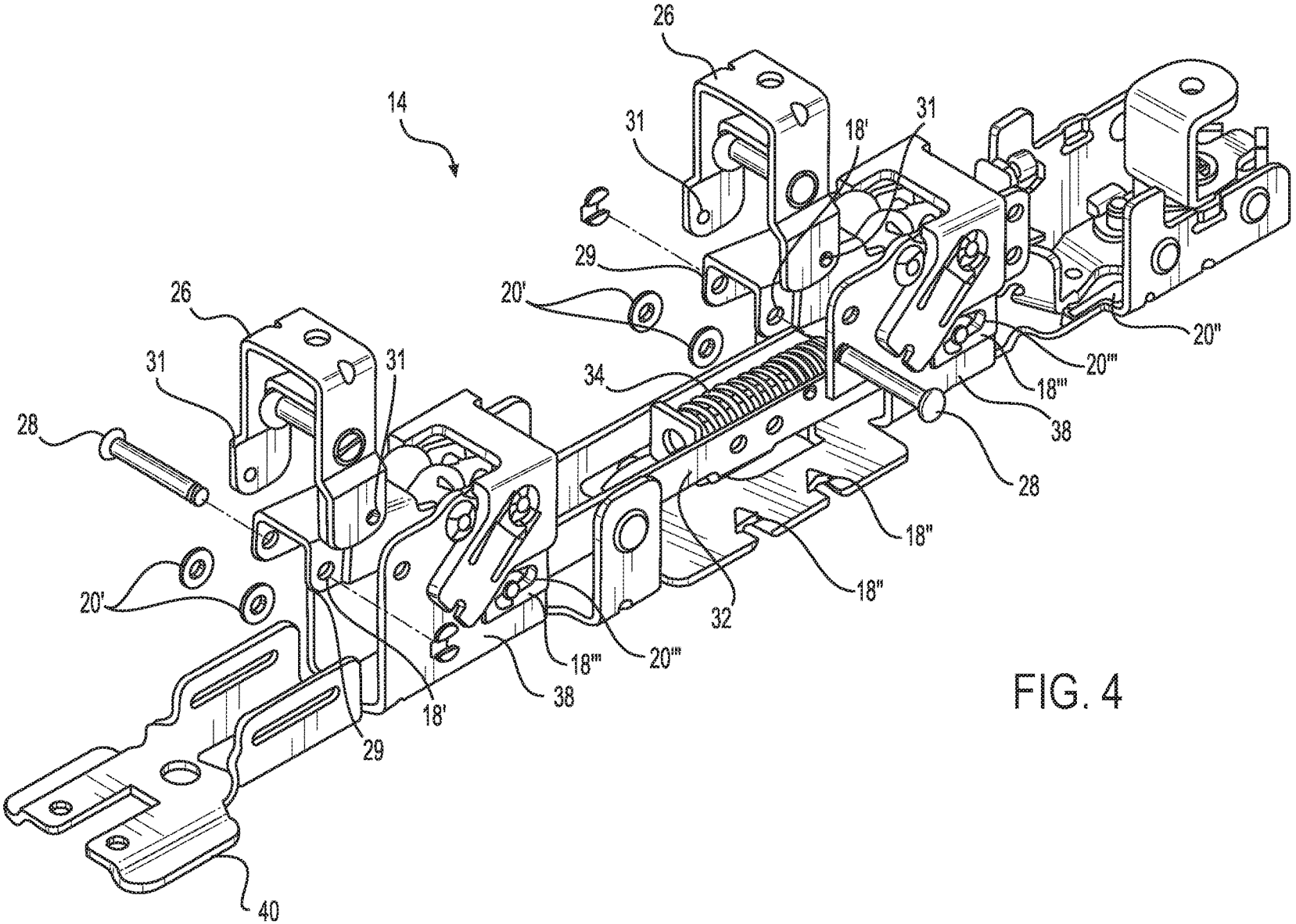
FIG. 4 is an exploded top perspective view of the push arm assembly of FIG. 3.

At least one sound dampening material 20, such as a washer 20', a pad 20", or a grommet 20'" (FIG. 4), is disposed at each of selected mechanical touch points 18. It is contemplated that the sound dampening material 20 is made of at least one of textile fabric, sheet metal, composite of carbon fiber, wood or honeycomb, plastic or rubber substance, or other suitable materials known in the art. As illustrated in FIG. 4, it is preferred that at least one washer 20' is disposed surrounding the pin 28 between the mounting bracket 26 and the push arm 29 at selected mechanical touch points 18'.

Figure 3:
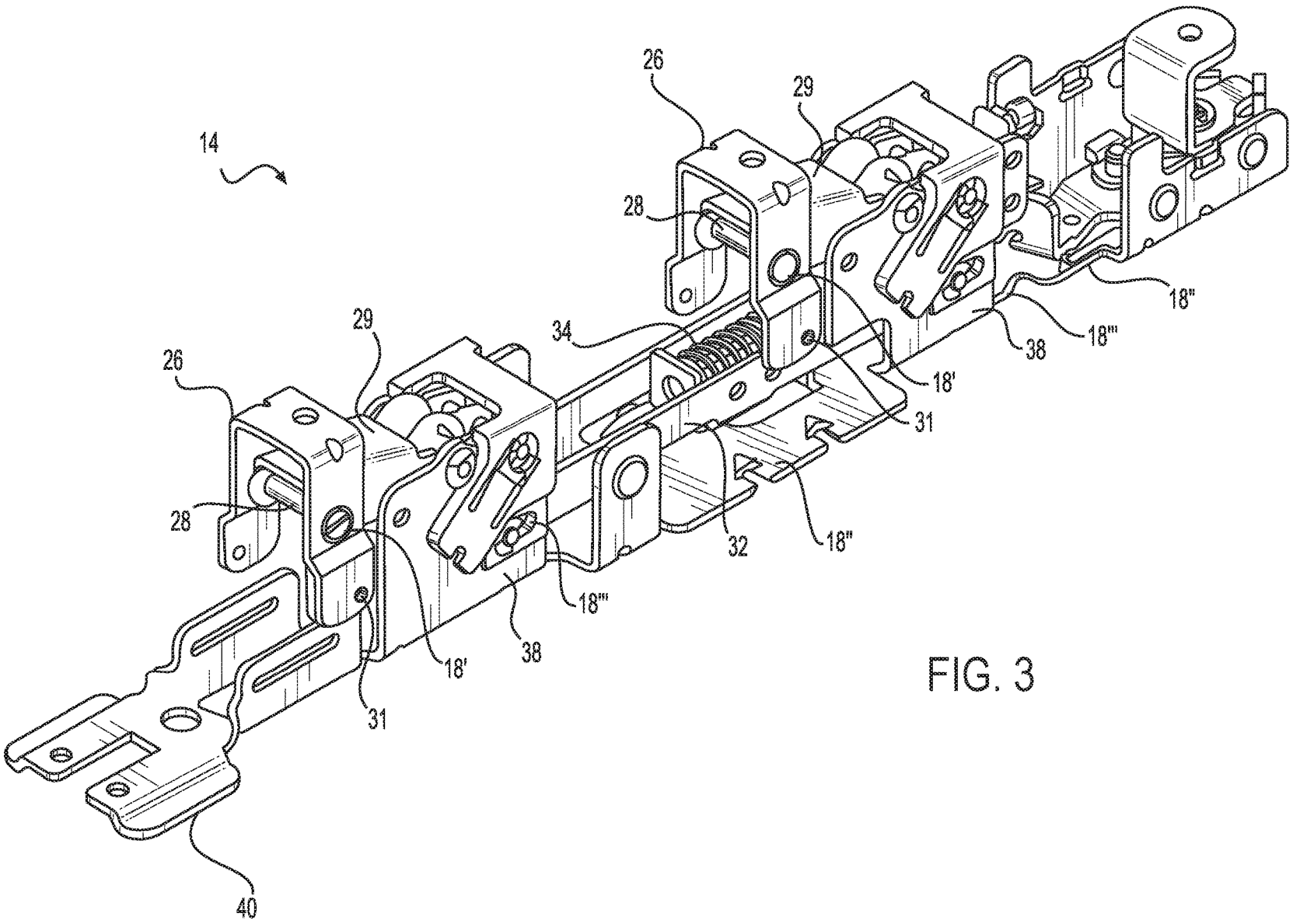
FIG. 3 is a fragmentary top perspective view of the push arm assembly of FIG. 1.
Figure 5:
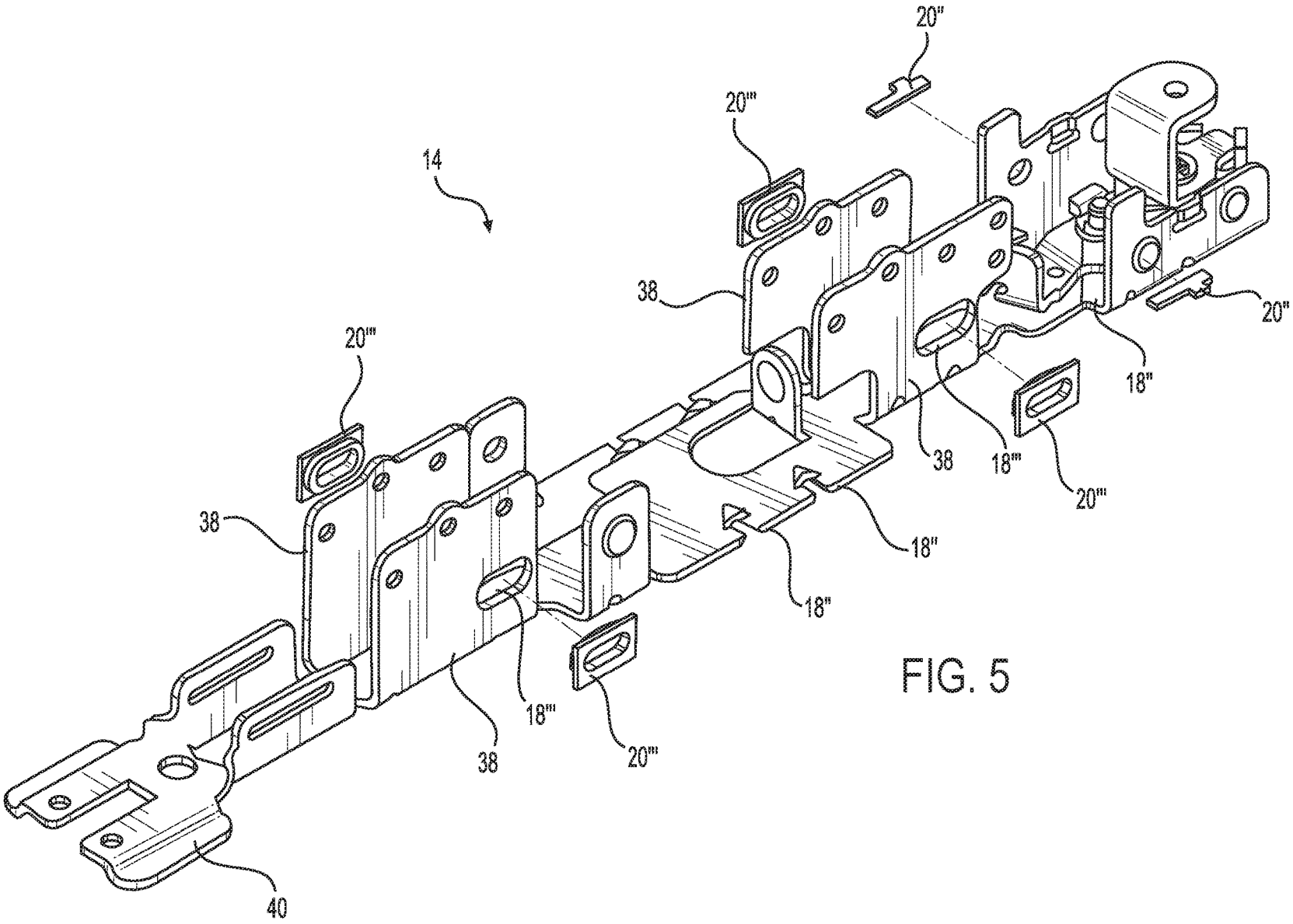
FIG. 5 is a top perspective view of a base of the push arm assembly of FIG. 3.

Referring now to FIG. 3, it is also contemplated that at least one pad 20" is disposed between the touch bar handle 12 and the push arm assembly 14 at selected mechanical touch points 18". The pads 20" are disposed on the outer edge 24 of the touch bar handle 12, such that the noise is reduced at selected mechanical touch points 18". As illustrated in FIG. 5, it is preferred that the push arm assembly 14 includes at least one side wall 38 having at least one grommet 20'" disposed between the wall 38 and the touch bar handle 12 at selected mechanical touch points 18'". A base 40 of the push arm assembly 14 accommodates the at least one pad 20" at selected mechanical touch points 18" when the touch bar handle 12 is depressed.

Figure 6B:
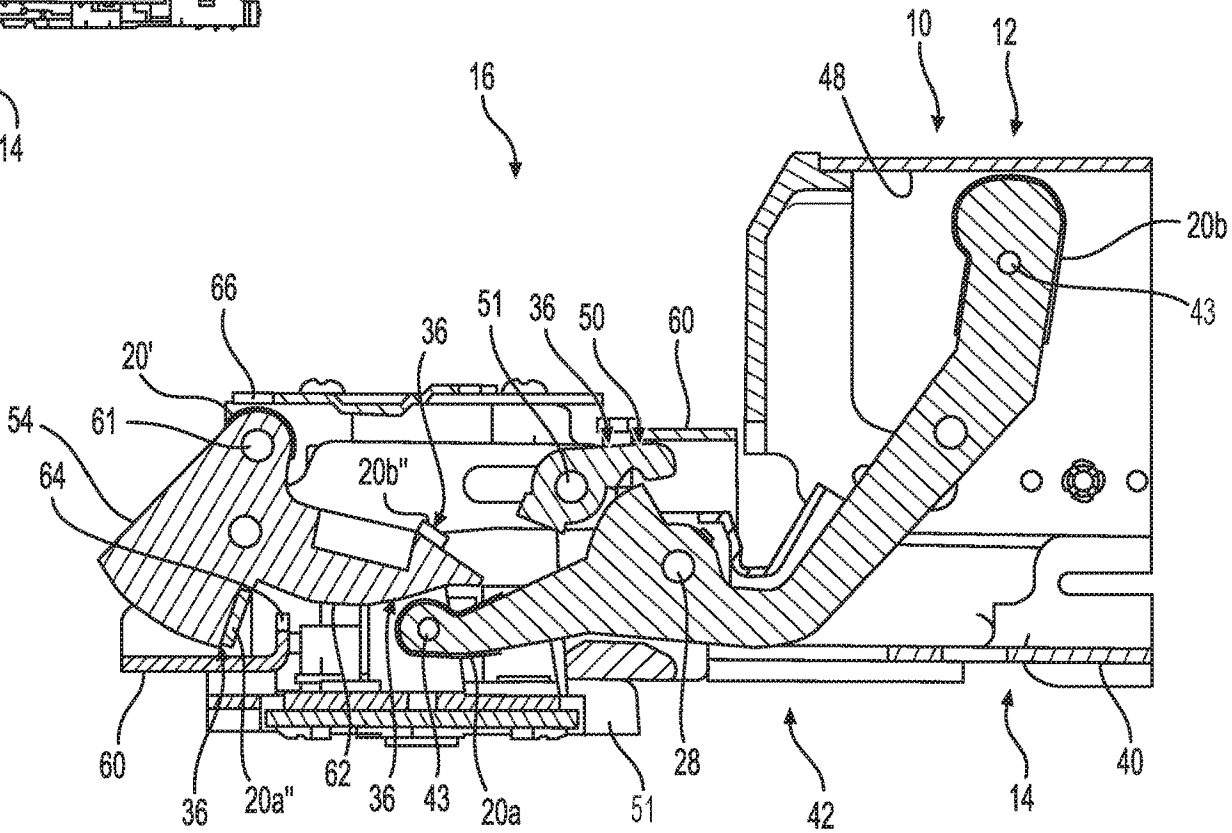
FIG. 6B is an enlarged fragmentary vertical cross-section of a square portion A of the latch mechanism shown in FIG. 6A.
Figure 6A:
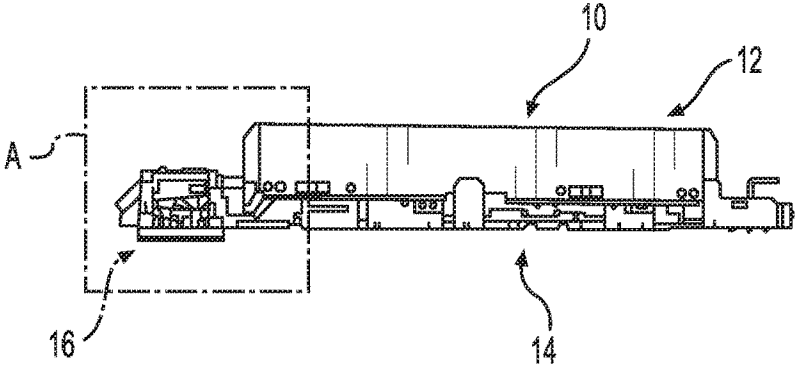
FIG. 6A is a side view of a latch mechanism connected to the push arm assembly of FIG. 1.
Figure 6C:
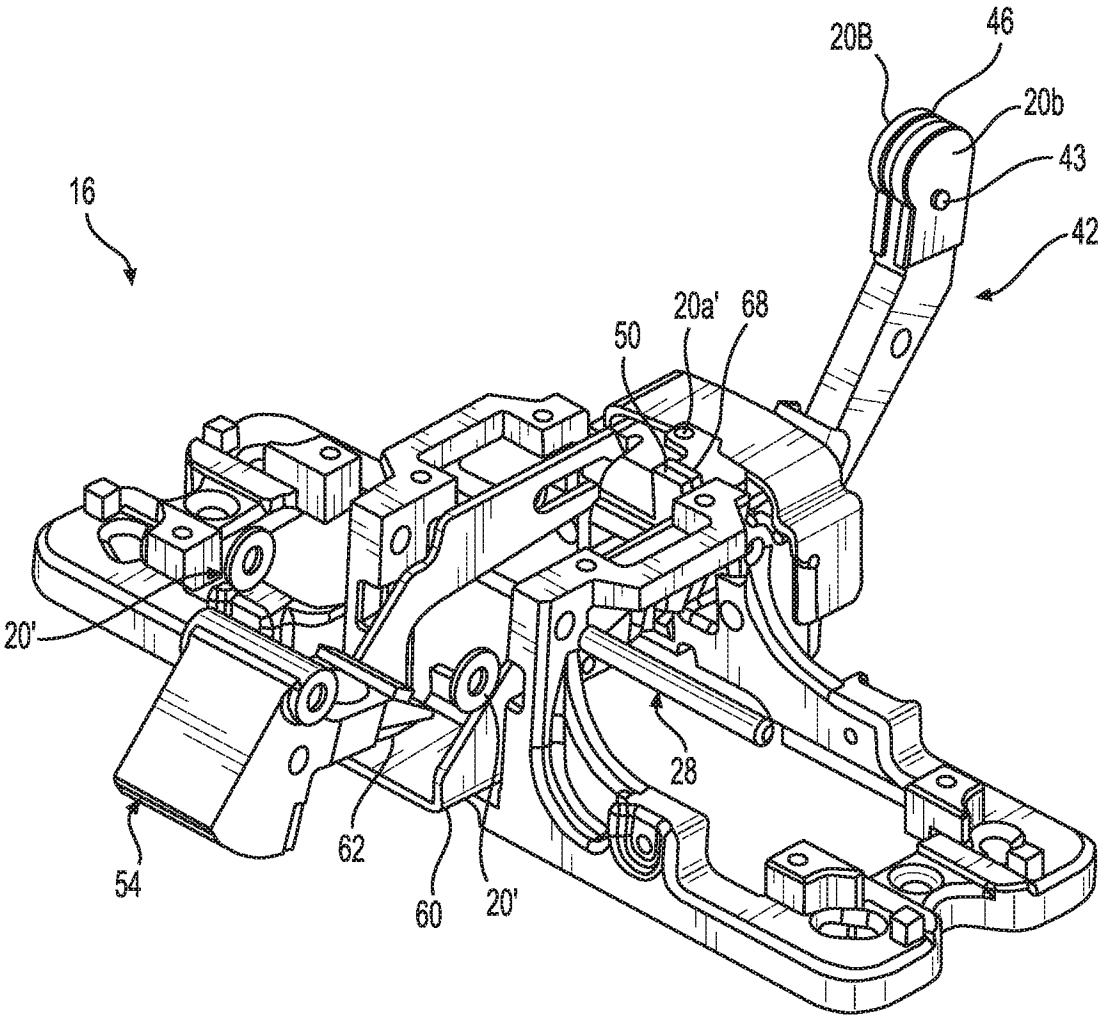
FIG. 6C is a top perspective view of the latch mechanism of FIG. 6B.
Figure 6D:
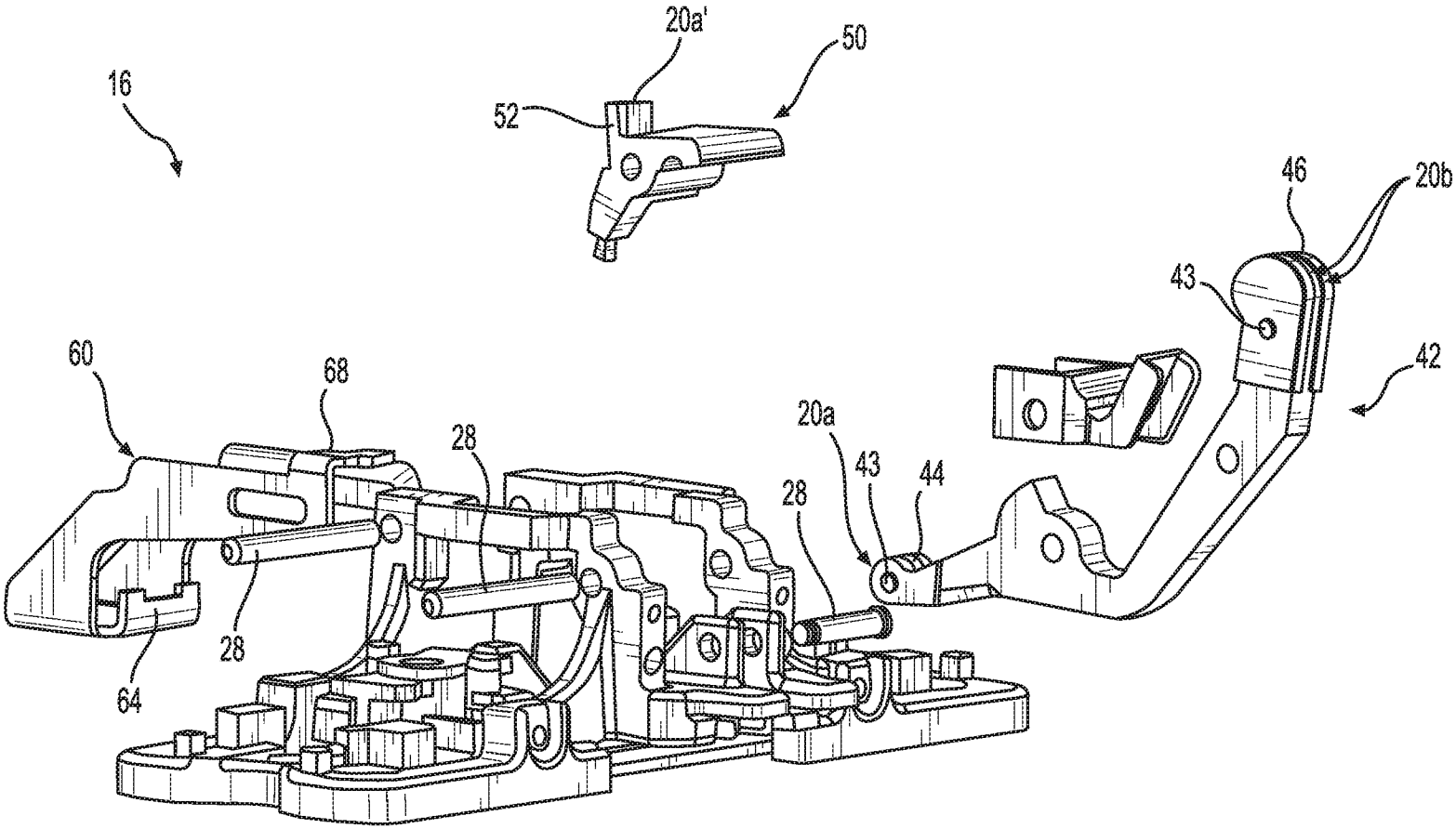
FIG. 6D is a rear exploded perspective view of the latch mechanism of FIG. 6B.
Figure 7B:
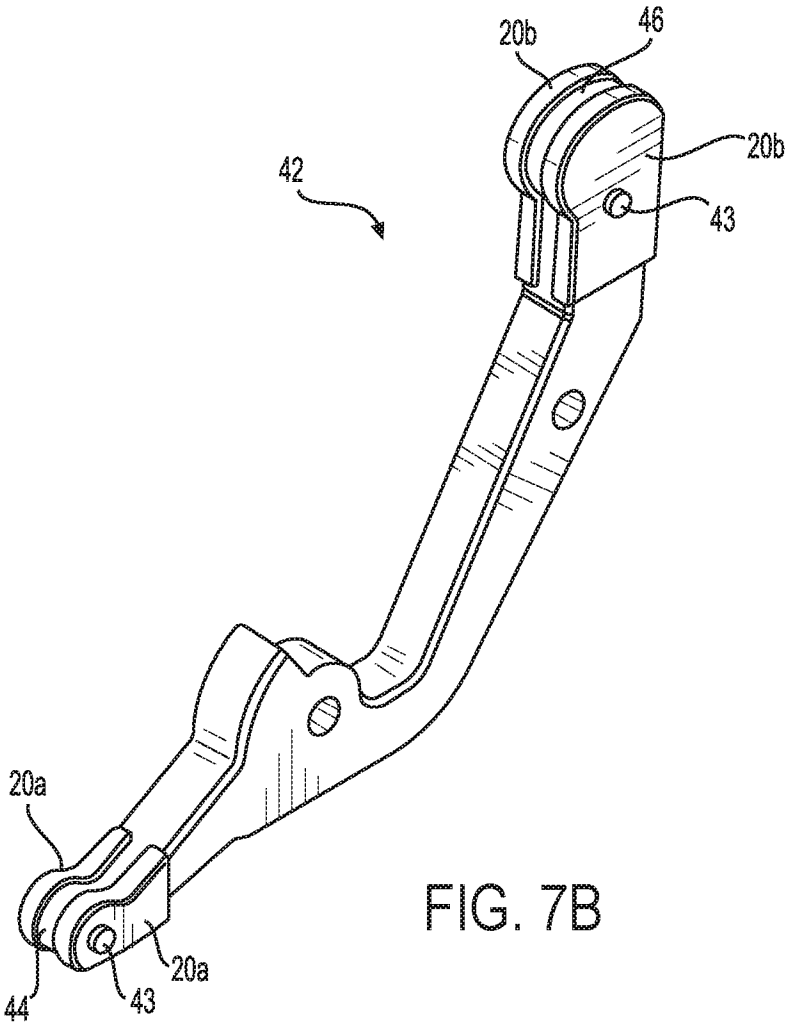
FIG. 7B is an assembled top perspective view of the lever arm assembly of FIG. 7A.
Figure 7A:
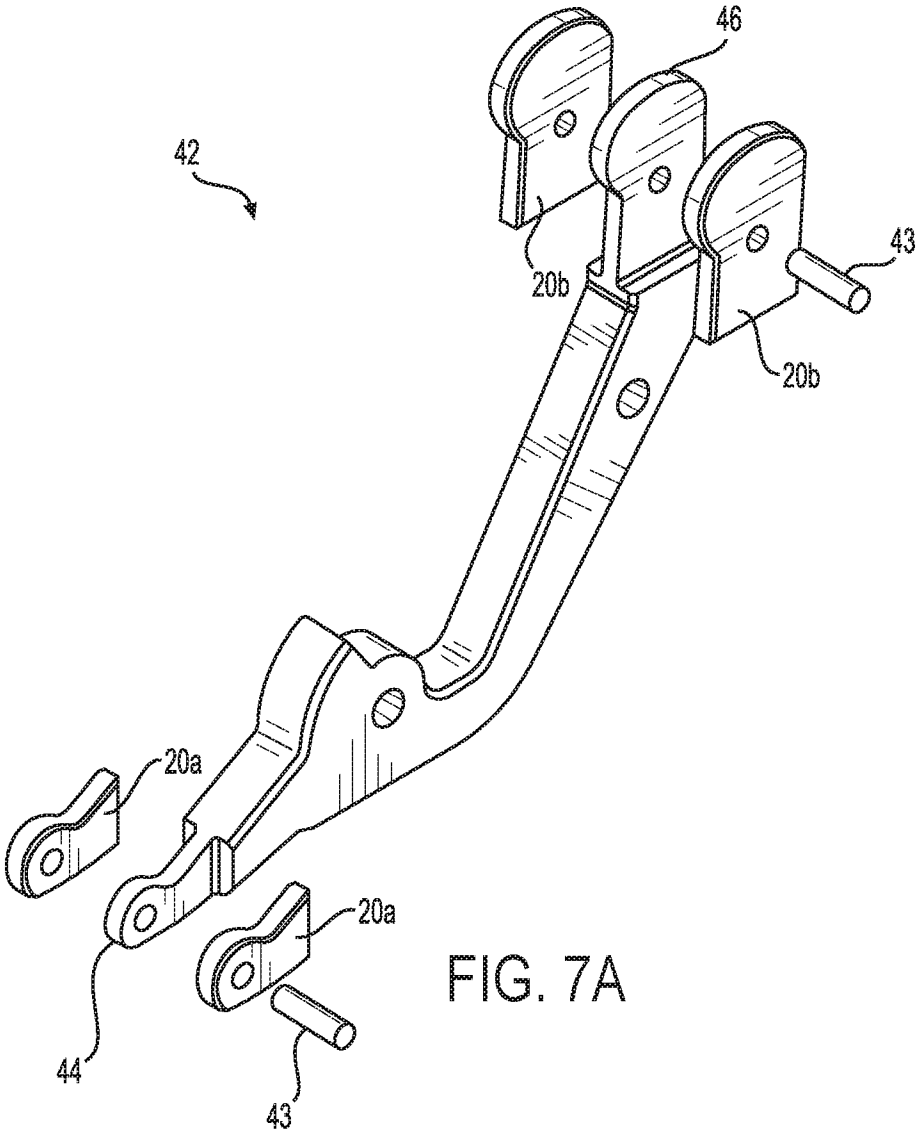
FIG. 7A is an exploded top perspective view of a lever arm assembly of the latch mechanism of FIG. 6D.
Figure 8B:
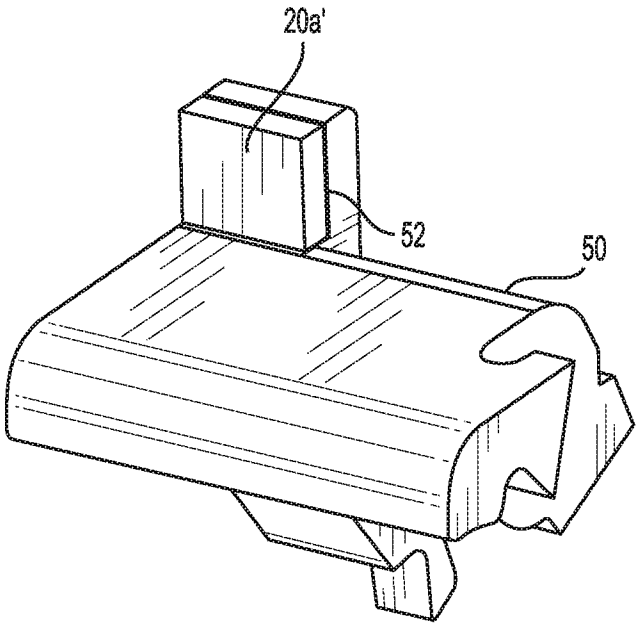
FIG. 8B is a top perspective view of the shroud stop of FIG. 8A.
Figure 8A:
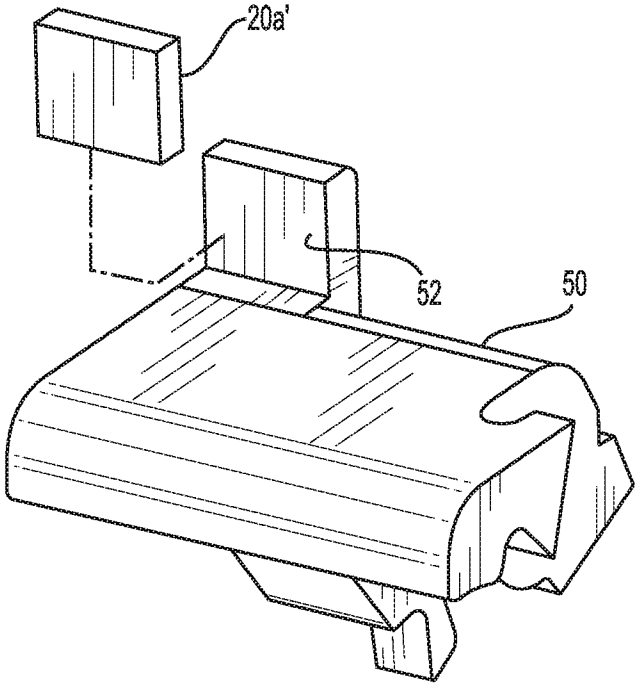
FIG. 8A is an exploded top perspective view of a shroud stop of the latch mechanism of FIG. 6D.
Figure 9B:
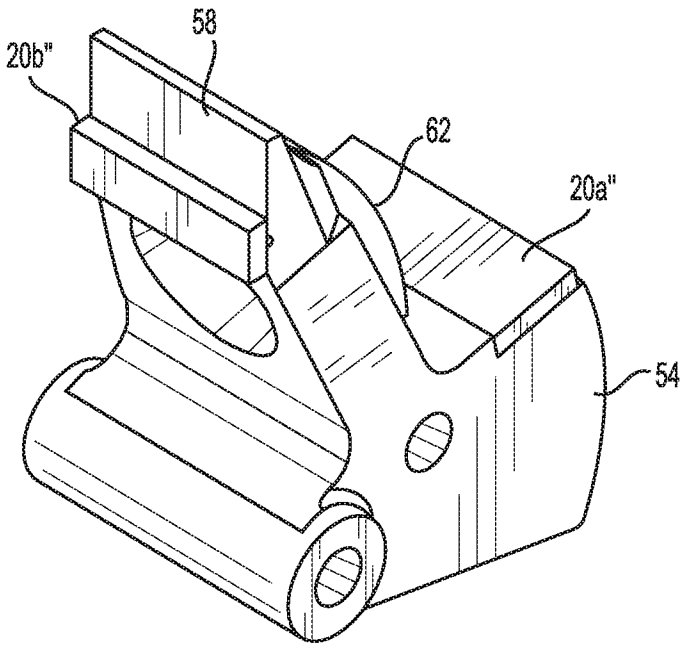
FIG. 9B is a top perspective view of the latch lock of FIG. 9A.
Figure 9A:
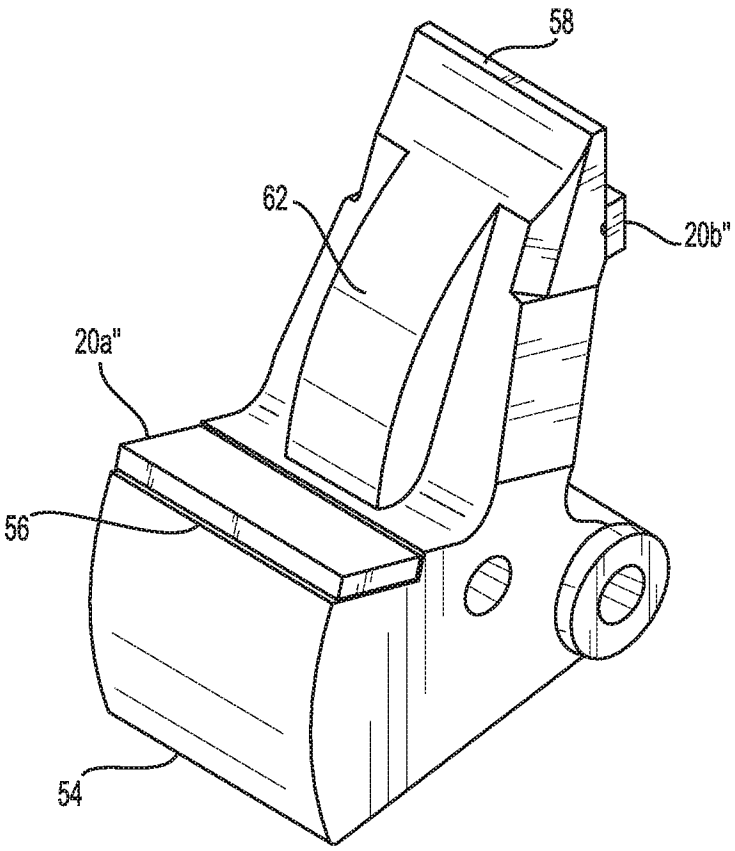
FIG. 9A is a bottom perspective view of a latch lock of the latch mechanism of FIG. 6C.

Referring now to FIGS. 1, 6A-6D and 7A-7B, it is contemplated that the latch mechanism 16 includes a lever arm assembly, generally designated 42, having at least one sound dampening material 20. It is preferred that the lever arm assembly 42 is pivotally connected to the latch mechanism 16 using the pin 28, and is constructed and arranged to actuate the latch mechanism (FIG. 6B).

In a preferred embodiment, the lever arm assembly 42 has a first sound dampening material **20*a*, such as the pad, at one end, and a second sound dampening material 20*b* at an opposite end. It is contemplated that the first sound dampening material 20*a* (FIGS. 7A and 7B) is disposed on a first end 44 of the lever arm assembly 42, and is configured to mechanically operate the latch mechanism 16. Similarly, the second sound dampening material 20*b* (FIGS. 7A and 7B) is disposed on a second end 46 of the lever arm assembly 42, and is configured to slidingly engage an inner surface 48 (FIG. 6B) of the touch bar handle 12. Attachment of the first and second sound dampening materials 20*a*, 20*b* to the lever arm assembly 42 is preferably achieved by using a pin 43**, an adhesive, or other suitable methods known in the art.

Referring now to FIGS. 1, 6B, 6D, 7A-7B and 8A-8B, it is contemplated that the latch mechanism 16 includes a shroud stop 50 (FIGS. 6B and 6D) having at least one sounding dampening material 20. As with the lever arm assembly 42, the shroud stop 50 is pivotally connected to the latch mechanism 16 via a pin 51, and is designed to limit movement of the latch mechanism 16. To reduce the impact or operating noise, the shroud stop 50 includes a first sound dampening material **20*a*', such as the pad, at a stop face 52 (FIGS. 8A and 8**B) of the shroud stop.

Referring now to FIGS. 1, 6B-6C, and 9A-9B, it is preferred that the latch mechanism 16 includes a latch lock 54 (FIGS. 9A and 9B) having at least one sound dampening material 20. More specifically, the latch lock 54 has a first sound dampening material 20*a*", such as the pad, at a head region 56 (FIG. 9A) of the latch lock, and a second sound dampening material 20*b*" at a leg region 58 (FIG. 9B) of the latch lock. In a preferred embodiment, the latch lock 54 is pivotally connected to a dead lock shroud 60 (FIGS. 6B and 6D) using a pin 61, and seated in a space defined by the dead lock shroud for facilitating pivotal movement of the latch lock 54. It is preferred that at least one washer 20' is disposed surrounding the pin 28 between the latch lock 54 and the dead lock shroud 60.

Returning now to FIGS. 1, 3, 6B-6D, and 9A, an exemplary operation of the present panic device 10 is shown. When the touch bar handle 12 is depressed to transition into a lower position overcoming the biasing force of the biasing device 34 (FIG. 3), the second sound dampening material 20*b* of the lever arm assembly 42 slidingly engages the inner surface 48 of the touch bar handle 12 (FIG. 6B). Simultaneously, the first sound dampening material 20*a* of the lever arm assembly 42 pushes upwardly an outer region 62 (FIGS. 6B and 9A) of the latch lock 54, such that the latch lock pivots inwardly and transitions into an unlock position to unlatch the latch mechanism 16.

In this movement, the first sound dampening material 20*a*" of the latch lock 54 directly engages a rear wall 64 (FIGS. 6B and 6D) of the dead lock shroud 60. As the latch lock 54 continues to pivot inwardly to push or engage the dead lock shroud 60 toward the lever arm assembly 42, a top plate 66 (FIG. 6B) of the latch mechanism 16 becomes engaged directly by the second sound dampening material 20*b*" of the latch lock. At this moment, the latch lock 54 is fully retracted to unlatch the latch mechanism 16, so that the access to the entryway is obtained.

Conversely, when the touch bar handle 12 is released to transition into an upper position under the action of the biasing device 34, the latch lock 54 pivots outwardly to return to its initial position, and transitions into a lock position under the action of another biasing device (not shown), such as a spring. For example, the biasing device can be connected between the top plate 66 and the dead lock shroud 60. When the touch bar handle 12 transitions into the upper position, the dead lock shroud 60 also returns to its initial position, such that the latch lock 54 transitions into the lock position. At this moment, the first sound dampening material 20*a*' at the stop face 52 of the shroud stop 50 engages a top portion 68 (FIGS. 6C and 6D) of the dead lock shroud 60.

As demonstrated above, it is advantageous that one or more sound dampening materials 20, 20*a*, 20*b*, 20*a*', 20*a*", 20*b*" cooperatively operate together to reduce or suppress the impact or operating noise created by various components of the present panic device 10. As a result, in this exemplary configuration, at least one mechanical touch point 18 of the present panic device 10 generates at least 20 percent (%) less decibels than conventional panic devices during operation.

The test results disclosed that the mean ambient sound level was 44.172 decibels, ranging from about 41 decibels to about 46 decibels. The mean sound level of the noise over ambient introduced by the present panic device 10 is about 0.01 decibels. In contrast, conventional panic devices introduced a mean sound level of noise over ambient from about 29 to about 35 decibels. Embodiments of the present panic device 10 were shown to dampen sound generated by movement of the panic device to about 15 decibels to 0.01 decibels over the ambient noise level. Further embodiments dampen sound generated by movement of the panic device ranged from about 10 decibels to 0.01 decibels over the ambient noise level. Additional embodiments dampen sound generated by movement of the panic device ranged from about 5 decibels to 0.01 decibels over the ambient noise level.

The test measurements also found that the dampening materials 20, 20*a*, 20*b*, 20*a*', 20*a*", 20*b*" of the panic device 10, individually or in combination, dampen sound generated by the panic device such that an increase in sound over the ambient noise level (which can range from 40 to 45 decibels) is less than about 37% to 0.022% of the ambient noise level. It is also contemplated that the increase over ambient noise by the operation of the present panic device 10 is about 25% to 0.022%. It is further contemplated that the increase over ambient noise by the operation of the present panic device 10 is about 12% to 0.022%. While particular embodiments of the present panic device have been shown and described, it will be appreciated by those skilled in the art that changes and modifications may be made thereto without departing from the present disclosure in its broader aspects and as set forth in the following claims.

What is claimed is:

1. A panic device for rapidly unlocking an entryway, comprising:

a touch bar handle configured for activating the panic device; and a push arm assembly mechanically connected to the touch bar handle, and configured for operating a latch mechanism connected to the push arm assembly via a plurality of linkages;

a plurality of mechanical touch points between said touch bar handle and said push arm assembly, at least one of said mechanical touch points having a sound dampening material disposed between contacting metal surfaces of said device, said mechanical touch points having said sound dampening material including said touch bar handle and said push arm assembly, said push arm assembly includes a mounting bracket connected to said touch bar handle, and a sidewall of said push arm assembly, wherein activation of the panic device, including depressing said touch bar handle, activating said push arm assembly, and the operation of said latch mechanism generates a noise reduction in the range of approximately 20-99 percent and at least 30 decibels during operation of said latch mechanism, wherein at least one of said mechanical touch points is disposed between said sidewall and said touch bar handle, and said at least one mechanical touchpoint includes said sound dampening material which is located within an opening in said sidewall.

2. The panic device of claim 1, wherein said sound dampening material includes at least one of: a washer, a pad, and a grommet.

3. The panic device of claim 1, wherein said panic device is configured to generate a transmission force between said touch bar handle and said push arm assembly, such that said latch mechanism is operated by the transmission force along a force path created by said plurality of linkages.

4. The panic device of claim 1, wherein said touch bar handle includes at least one sound dampening material between said touch bar handle and said push arm assembly.

5. The panic device of claim 1, wherein said push arm assembly includes said mounting bracket connected to said touch bar handle, and at least one sound dampening material is disposed between said mounting bracket and said push arm assembly.

6. The panic device of claim 1, wherein said push arm assembly includes said at least one side wall having at least one sound dampening material.

7. The panic device of claim 1, wherein said push arm assembly includes a base having at least one sound dampening material.

8. The panic device of claim 1, wherein said latch mechanism includes a lever arm assembly having at least one sound dampening material.

9. The panic device of claim 8, wherein said lever arm assembly has a first sound dampening material at one end, and a second sound dampening material at an opposite end.

10. The panic device of claim 9, wherein the first sound dampening material is disposed on a first end of the lever arm assembly, and is configured to mechanically operate said latch mechanism.

11. The panic device of claim 9, wherein said second sound dampening material is disposed on a second end of said lever arm assembly, and configured to slidingly engage an inner surface of said touch bar handle.

12. The panic device of claim 1, wherein said latch mechanism includes a latch lock having at least one sound dampening material.

13. The panic device of claim 12, wherein said latch lock has a first sound dampening material at a head region of said latch lock, and a second sound dampening material at a leg region of said latch lock.

14. The panic device of claim 1, wherein said latch mechanism includes a shroud stop having at least one sounding dampening material.

15. The panic device of claim 14, wherein said shroud stop has a first sound dampening material at a stop face of said shroud stop.

16. A panic device for rapidly unlocking an entryway, comprising:

a touch bar handle configured for activating said panic device;

a push arm assembly mechanically connected to said touch bar handle, and configured for operating a latch mechanism connected to said push arm assembly via a plurality of linkages;

a plurality of mechanical touch points disposed between said touch bar handle and said push arm assembly, said mechanical touch points having said sound dampening material including said touch bar handle and said push arm assembly, push arm assembly includes a mounting bracket connected to said touch bar handle, a sidewall of said push arm assembly, a base of said push arm assembly, said latch mechanism having a lever arm, a latch lock on said latch mechanism, said latch lock having at least one sound dampening material; and at least one sound dampening material disposed between opposing metal surfaces of at least one of said plurality of mechanical touch points, wherein said latch lock engages a dead lock shroud of said latch mechanism, and said lever arm engages said latch lock, such that activation of said touch bar causes said lever arm to engage said latch lock, thereby causing said latch lock to push against said dead lock shroud, unlatching said latch mechanism.

17. The panic device of claim 16, wherein said at least one sound dampening material includes at least one of: a non-metallic washer, a sound absorbing pad, and a grommet.

18. The panic device of claim 16, wherein said at least one sound dampening material is disposed between said mounting bracket of said push arm assembly and at least one side wall of said push arm assembly.

19. The panic device of claim 16, wherein said latch lock has a first sound dampening material at a head region of said latch lock, and a second sound dampening material at a leg region of said latch lock.

20. The panic device of claim 16, wherein said lever arm has a first sound dampening material at one end, and a second sound dampening material at an opposite end.

* * * * *